US006272895B1

(12) United States Patent
Hamm

(10) Patent No.: US 6,272,895 B1
(45) Date of Patent: Aug. 14, 2001

(54) ROLL GROOVING APPARATUS

(75) Inventor: James E. Hamm, Grafton, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/571,145

(22) Filed: May 16, 2000

(51) Int. Cl.[7] ..... B21D 17/04
(52) U.S. Cl. ..... 72/105
(58) Field of Search ..... 72/101, 105, 106; 470/67

(56) References Cited

U.S. PATENT DOCUMENTS

| | | | |
|---|---|---|---|
| 2,809,687 | 10/1957 | Ogle . | |
| 3,015,502 | 1/1962 | Frost et al. . | |
| 3,541,826 | 11/1970 | Halliburton . | |
| 3,995,466 | 12/1976 | Kunsman . | |
| 4,041,747 | 8/1977 | Elkin . | |
| 4,144,733 | 3/1979 | Whitten . | |
| 4,166,370 | 9/1979 | Goodman . | |
| 4,210,008 * | 7/1980 | Birkestrand | 72/105 |
| 4,848,121 | 7/1989 | Rottinghaus . | |
| 4,930,326 | 6/1990 | Rottinghaus . | |
| 5,528,919 | 6/1996 | McGrady et al. . | |

OTHER PUBLICATIONS

Brochure from the Victaulic Tool Company of Easton, PA, dated Jan. 1990, showing the Vic–Easy Series 226S Roll Groover.

* cited by examiner

*Primary Examiner*—Lowell A. Larson
(74) *Attorney, Agent, or Firm*—Vickers, Daniels & Young

(57) ABSTRACT

Roll grooving apparatus for rolling a circumferential groove in a pipe is adapted to be mounted on a power drive unit for the axes of the driven and idler grooving rolls to lie in a plane which is one of horizontal or at an acute angle to horizontal such that the weight of a pipe between the grooving rolls during a roll grooving operation promotes tracking of the groove. A rotatable groove depth gauge is mounted on a support member of the apparatus adjacent a stop element which engages the support member to determine groove depth, and the gauge is displaceable relative to the stop element into and out of a gauging position in which the stop element can be set to control the groove depth in a given workpiece.

49 Claims, 7 Drawing Sheets

ROLL GROOVING APPARATUS

BACKGROUND OF THE INVENTION

This invention relates to the art of roll grooving apparatus and, more particularly, to improvements in such apparatus relating to maintaining tracking between the grooving rolls and workpiece, stabilizing the apparatus during operation thereof and gauging the depth of rolled grooves.

The present invention finds particular utility in connection with portable roll grooving apparatus of the character removably mountable on a separate power drive unit including spaced apart and parallel support elements and a drive motor having a drive coupling for driving interconnection with a drive shaft of the roll grooving apparatus. Accordingly, the invention will be illustrated and described herein in connection with such a portable roll groover. However, it will be understood and appreciated from the disclosure herein that the invention is applicable to roll grooving apparatus integrally associated with a support and drive mechanism.

Roll grooving apparatus is of course well known, and generally, includes relatively displaceable first and second support components respectively rotatably supporting a driven grooving roll and an idler grooving roll between which a pipe to be grooved is interposed during a grooving operation. The grooving rolls are matingly contoured and, in this respect, the driven roll is provided with a peripheral groove and the idler roll is provided with a peripheral projection such that a pipe therebetween is provided with a peripheral groove upon relative rotation of the grooving rolls and relative radial displacement of the grooving rolls toward one another. Heretofore, the grooving roll axes have been vertically aligned and the displacement of the support components toward and away from one another is achieved either hydraulically or through the use of a threaded feed screw capable of accommodating a tool such as a wrench for manually rotating the feed screw. Often, the two support components are provided with an adjustable stop arrangement therebetween by which the relative displacement of the grooving rolls in the direction to form a groove in a workpiece is controlled to provide a depth of the groove appropriate for a given workpiece based on such factors as the diameter of the workpiece, the material of the workpiece and the wall thickness thereof Heretofore, a plurality of individual thickness gauges, or a gauge having multiple steps, have been tethered to the roll grooving apparatus, such as by a chain, for interposition between a stop member on one of the support components and a surface on the other support component to provide the necessary space therebetween for achieving the desired groove depth. In connection with performing a roll grooving operation with such apparatus, the grooving rolls are separated and a pipe to be grooved is inserted therebetween and held by the operator of the apparatus as the grooving rolls are displaced toward one another. The driven grooving roll imparts rotation to the pipe which in turn imparts rotation to the idler grooving roll and the latter is gradually advanced toward the driven roll to progressively form the peripheral groove in the pipe.

There are a number of problems and/or disadvantages associated with the structure and operation of roll grooving apparatus of the foregoing character. In this respect, for example, it is necessary for the pipe and grooving roll axes to be properly aligned during a roll grooving operation so that the track of the groove is transverse to the pipe axis. Misalignment at the beginning of an operation can cause the track of the groove to be spiral relative to the pipe axis whereby the pipe "walks" in the direction to axially separate the rolls and pipe. Accordingly, the operator must support the pipe in one hand while the idler grooving roll is advanced toward the driven grooving roll and, in connection with achieving the latter advancement through a feed screw mechanism, the operator must support the pipe with one hand and rotate the feed screw with the other, such as through use of a wrench. In any event, the combined pipe supporting and screw rotating requirements are awkward for the operator and difficult to achieve at the same time. Furthermore, the pipe grooving apparatus is generally supported on a bench or mounted on a stand elevated above a supporting surface such as a floor and, with a feed screw arrangement, the torque required to be applied to the vertical feed screw during a roll grooving operation is considerable and is applied by the operator by rotating the feed screw about a vertical axis which often results in the apparatus slipping relative to the underlying bench or floor or tipping relative thereto, especially when the directional force on the wrench is moving laterally outwardly of the drive shaft axis.

Another disadvantage resides in the fact that the operator, in adjusting the stop arrangement for a given roll grooving operation, must select the appropriate one of a plurality of individual thickness gauges, or the appropriate step of a single gauge, insert the latter in the space between the stop element and underlying support member, make the necessary adjustment and then remove the thickness gauge and return the latter to its storage location. Accordingly, the gauging procedure is time consuming, especially if the gauge or set of thickness gauges is not tethered or otherwise attached to the apparatus and the operator must put them in a pocket or otherwise store the set. Moreover, if the gauge or gauges become separated from the apparatus and/or misplaced, or lost, the operator must either rely upon guesswork in adjusting the stop arrangement or, alternatively, rely on a visual tracking of the groove depth to determine when the latter is appropriate for a given workpiece. While an experienced operator may be capable of performing an acceptable roll grooving operation in the foregoing manner, it is unlikely that an inexperienced operator could do so, whereby the potential for material loss through inappropriate grooving exists.

SUMMARY OF THE INVENTION

In accordance with the present invention, improvements are provided in roll grooving apparatus by which the foregoing and other problems and/or disadvantages are minimized or overcome. More particularly in this respect, and in accordance with one aspect of the invention, a support arrangement is provided for roll grooving apparatus which promotes tracking of a pipe being grooved with little or no user intervention to physically support the pipe during the roll grooving operation. The support arrangement provides for a plane through the axes of the grooving rolls to be one of horizontal or at an acute angle to horizontal, whereby the feed screw or other actuating mechanism for displacing the grooving rolls relative to one another is located laterally outwardly of the apparatus. With the grooving rolls in such a disposition relative to one another, the weight of a pipe therebetween which is being grooved promotes tracking, thereby minimizing or eliminating the need for the operator to apply a force to the pipe to promote tracking.

In accordance with another aspect of the invention, when the actuating mechanism is a feed screw the axis of the feed screw is one of horizontal or at an acute angle to horizontal and the operating end thereof is laterally outwardly adjacent the apparatus. Accordingly, rotation of the feed screw such as by a wrench provides for the force to be applied in a generally vertical plane which stabilizes the apparatus during the grooving operation against sliding and/or tilting relative to the support surface therebeneath and, to the extent the operator may need to support the pipe to optimize tracking, minimizes the awkwardness and difficulty of holding the pipe and displacing the wrench at the same time.

In use of the roll grooving apparatus mounted in the foregoing manner, the initial advancement of the grooving rolls relative to one another results in the pipe therebetween rising from an initial position in which the rolls are separated a considerable distance to a position in which grooving of the pipe begins. As mentioned above, the weight of the pipe promotes tracking, thereby minimizing the need for an operator to apply a force to the pipe to promote tracking. In accordance with still another aspect of the present invention, the roll grooving apparatus is provided with a stabilizing wheel which may be fixed or spring loaded for engagement by the pipe as it approaches or when it reaches a position at which roll grooving commences. This provides for the pipe to be preloaded against the wheel to further stabilize against spiraling.

In accordance with yet another aspect of the invention, roll grooving apparatus is provided with a gauge element which is mounted thereon adjacent to the stop element and for displacement relative to the support component of the roll grooving apparatus for selective displacement of one of a plurality of gauging surface portions to and from a gauging position between the stop element and support component. Accordingly, the operator can displace the gauge into a gauging position between the stop member and support component, adjust the stop member and then quickly move the gauge out of the gauging position to enable operation of the apparatus to achieve roll grooving. The gauge advantageously is mounted on and thus remains on the roll grooving apparatus against displacement therefrom and adjacent the stop member, whereby a gauging operation requires a minimum number of manual manipulations on the part of the user.

It is accordingly an outstanding object of the present invention to provide roll grooving apparatus with structural improvements promoting tracking of a pipe during a roll grooving operation.

Another object is the provision of roll grooving apparatus with structural improvements promoting stability of the apparatus during operation thereof to achieve roll grooving.

Yet another object is the provision of roll grooving apparatus with structural improvements promoting the capability of obtaining a desired groove depth in connection with a given workpiece.

Still another object is the provision of roll grooving apparatus with structural improvements which minimize or eliminate the difficulty and awkwardness of an operator performing multiple manual manipulations of component parts at the same time during a roll grooving operation.

BRIEF DESCRIPTION OF THE DRAWINGS

The foregoing objects, and others, will in part be obvious, and in part pointed out more fully hereinafter in conjunction with the written description of preferred embodiments of the invention illustrated in the accompanying drawings in which.

DESCRIPTION OF PREFERRED EMBODIMENTS

Figure 1:
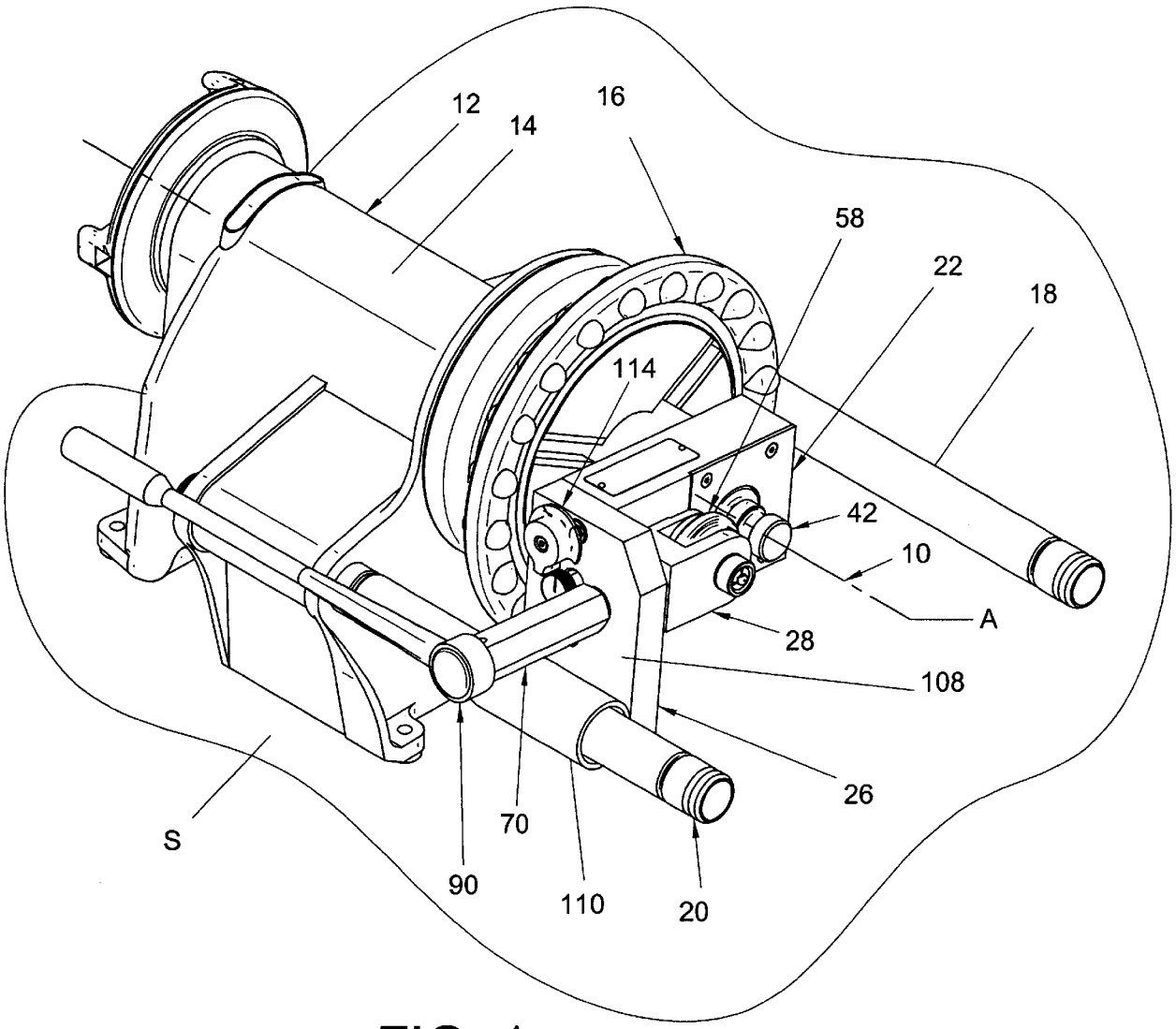
FIG. 1 is a perspective view of portable roll grooving apparatus mounted on a support and power unit in accordance with the invention.
Figure 2:
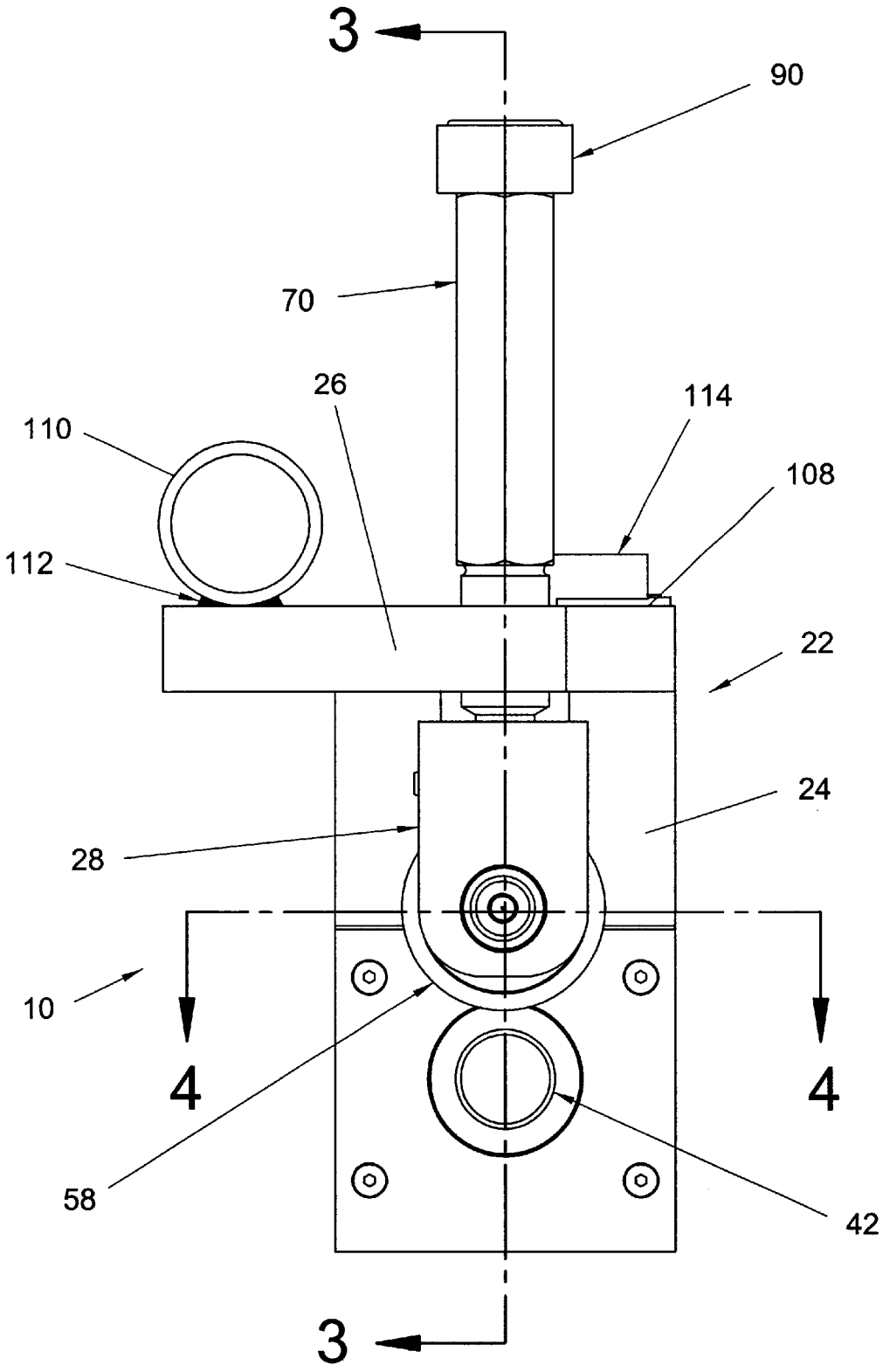
FIG. 2 is a front elevation view of the roll grooving apparatus and power unit shown in FIG. 1.

Referring now in greater detail to the drawings, wherein the showings are for the purpose of illustrating preferred embodiments of the invention only and not for the purpose of limiting the invention, FIGS. 1–4 illustrate roll grooving apparatus 10 mounted on a support and drive unit 12 which, as is well known, includes a housing 14 adapted to be supported on an underlying surface S such as a bench or stand, and a rotatable chuck mechanism 16 driven by an electric motor in housing 14 through a suitable gear transmission. Housing 14 also supports a pair of tubular elements 18 and 20 which are laterally spaced apart and parallel to one another and which extends forwardly of the power drive unit to in turn support roll grooving apparatus 10 in the manner set forth more fully hereinafter. Chuck mechanism 16 of the power drive unit has an axis A which, as will become apparent hereinafter, is coaxial with the axis of the drive shaft of roll grooving apparatus 10 when the latter is mounted on the power drive unit.

Roll grooving apparatus 10 comprises a first support member 22 having a base or first portion 24 transverse to axis A and a second or outer plate portion 26 laterally spaced from and parallel to axis A and mounted on base portion 24 by a plurality of socket head cap screws 27. Apparatus 10 further includes a second support member 28 slidably interengaged with support member 22 as set forth more fully hereinafter for displacement relative thereto radially inwardly and outwardly of axis A. A drive shaft 30 is rotatably supported in a bearing sleeve 32 at the inner end of base portion 24 by a ball bearing unit 34 at the rear end of the sleeve and a roller bearing unit 32 at the front end thereof Shaft 30 is coaxial with axis A and includes a rear end 38 adapted to be coupled with chuck mechanism 16 of power drive unit 12 for rotation thereby and a front end 40 which includes a driven grooving roll 42 which, in the embodiment illustrated, is integral with the drive shaft and accordingly has a roll axis coinciding with axis A. In a well-known manner, grooving roll 42 includes axially spaced apart circular portions 44 and 46 and a peripheral recess 48 therebetween.

Figure 3:
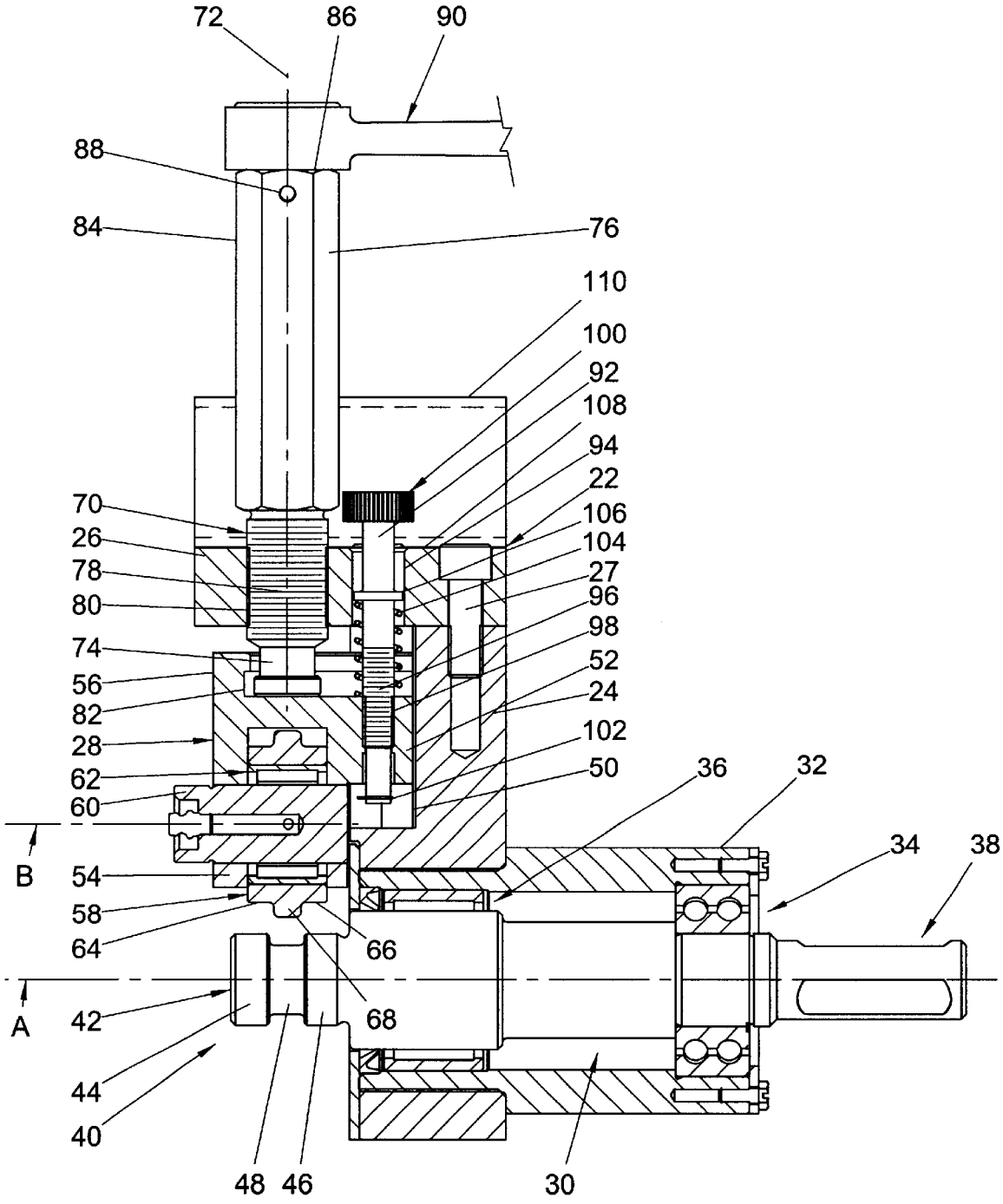
FIG. 3 is a sectional elevation view of the apparatus taken along line 3—3 in FIG. 2.
Figure 4:
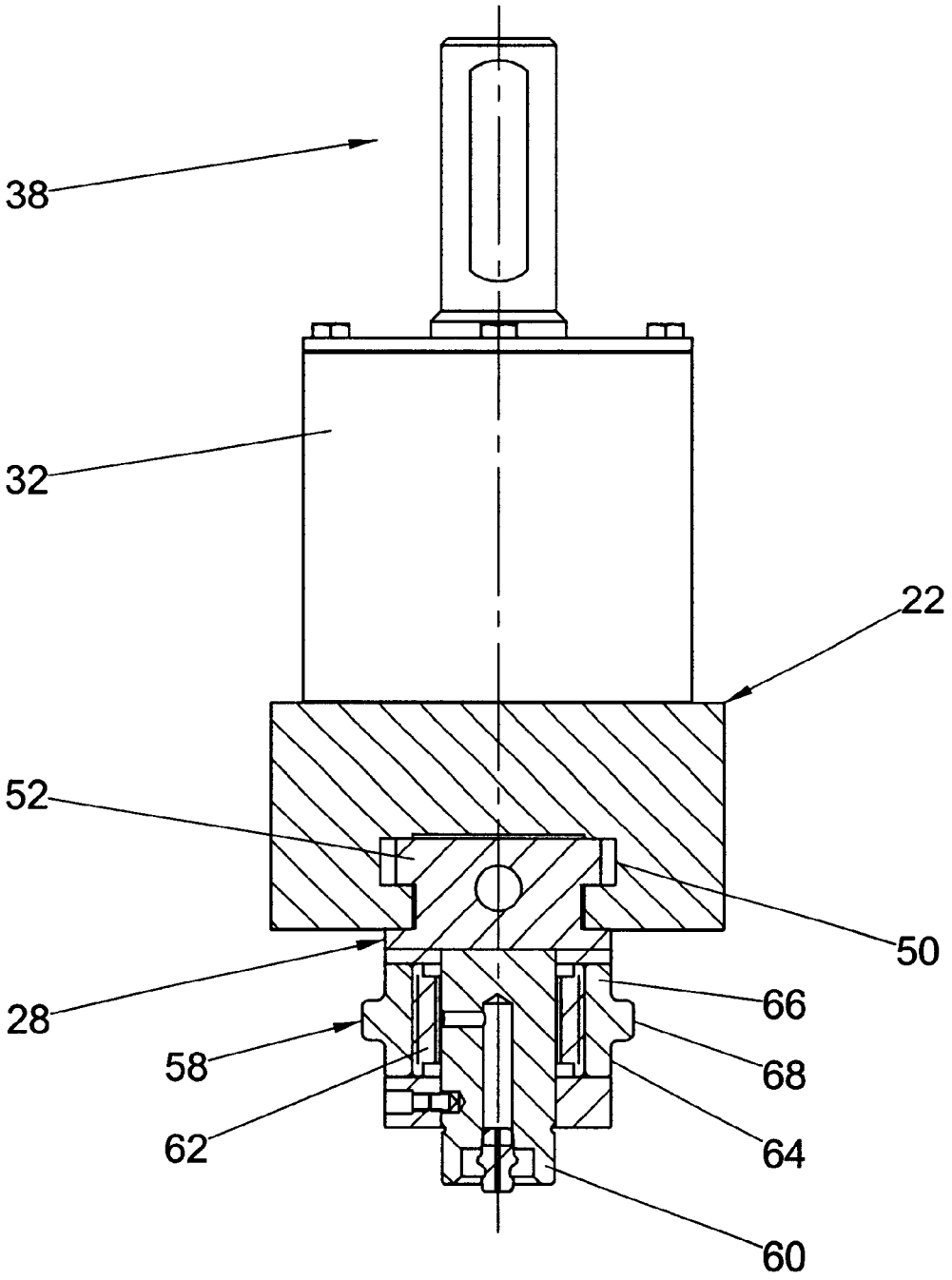
FIG. 4 is a plan view in section of the roll grooving apparatus taken along line 4—4 in FIG. 2.
Figure 6:
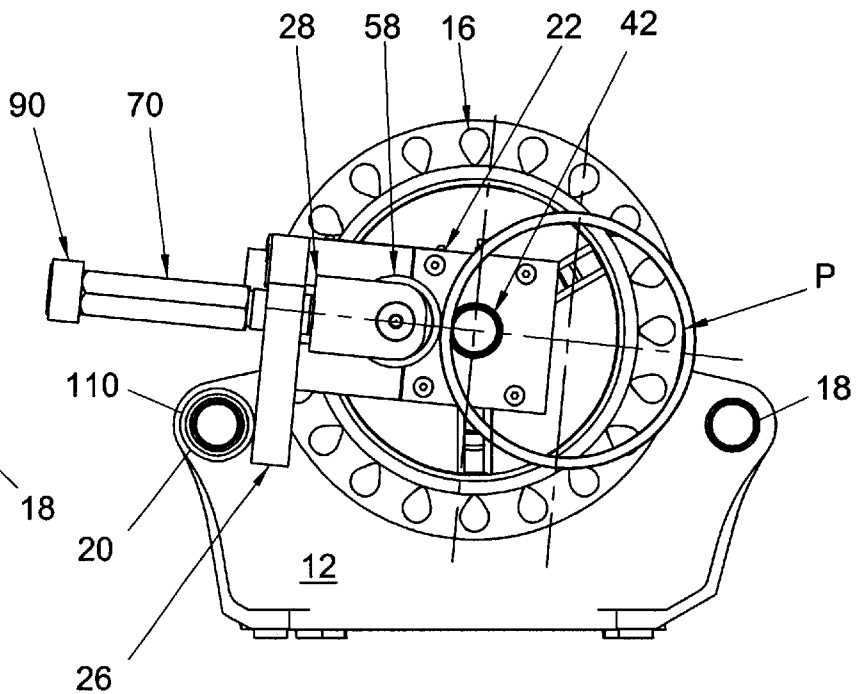
FIG. 6 is a view similar to FIG. 5 and showing the relationship between the pipe and grooving rolls at the onset of grooving.

As best seen in FIGS. 3 and 4, base portion 24 of first support member 22 is provided with a T-shaped recess 50 extending radially with respect to axis A, and second support member 28 includes an inner slide portion 52 configured to sidably interengage with recess 50 to support member 28 against displacement axially outwardly of recess 50. Second support member 28 has radially inner and outer ends 54 and 56, respectively, and an idler grooving roll 58 is mounted on inner end 54 for rotation about an idler roll axis B and for displacement with support member 28 radially inwardly and outwardly of axis A. More particularly with regard to the mounting of idler roll 58, the latter is rotatably supported on an idler roll shaft 60 by a roller bearing unit 62 interposed therebetween and, in a well-known manner, the idler grooving roll includes circular portions 64 and 66 respectively overlying portions 44 and 46 of grooving roll 42, and a radially outwardly extending circular projection 68 therebetween and overlying recess 48 in grooving roll 42.

Second support member 28 is adapted to be slidably displaced relative to first support member 22 so as to displace grooving roll 58 radially inwardly and outwardly relative to grooving roll 42 and, for this purpose, the roll grooving apparatus includes a feed screw 70 rotatable about a feed screw axis 72 extending radially through axes A and B. Feed screw 70 has inner and outer ends 74 and 76, respectively, and an intermediate portion 78 threadedly interengaged with a threaded bore 80 provided therefor in outer plate portion 26 of support member 22. Preferably, for the purpose set forth hereinafter, intermediate portion 78 of feed screw 70 is provided with a left-hand thread. Inner end 74 of the feed screw is necked in and provided with a circular head, not designated numerically, which is rotatably received in a stepped recess 82 in outer end 56 of support member 28 and which head and recess interengage for the feed screw to radially displace support member 28 in opposite directions in response to rotation of the feed screw in opposite directions about axis 72. Outer end 76 of the feed screw is provided with a hexagonal outer surface 84 to facilitate rotation of the feed screw by an appropriately sized wrench and, preferably, the terminal end of the feed screw is provided with a socket 86 for receiving the operating shaft 88 of a ratchet wrench 90 by which the feed screw can be rotated.

A stop arrangement is provided for limiting displacement of second support member 28 and thus grooving roll 58 radially inwardly toward grooving roll 42, thus to control the depth of a groove rolled in a pipe during use of the apparatus. The stop arrangement includes a spindle 92 extending through an opening 94 provided therefor in outer plate portion 26 of support member 22 and having an inner end 96 threadedly interengaged with a threaded bore 98 provided therefor in support member 28. The outer end of spindle 92 is provided with a stop element 100 in the form of a knob by which the spindle can be rotated and displaced radially outwardly and inwardly relative to support member 28. The innermost end of spindle 92 is provided with a retaining ring 102 which is adapted to interengage with the radially inner side of axially inner portion 52 of support member 28 to preclude separation of the spindle from the latter support member, and a biasing spring 104 is interposed between the upper side of recess 82 in support member 28 and a collar 106 on spindle 92 so as to restrain rotation of the spindle from a set position during operation of the apparatus. In the position of the component parts of the roll grooving apparatus shown in FIG. 3, knob 100 is spaced radially outwardly from the radially outer surface 108 of plate portion 26 of support member 22 and which space is adjustable by rotating spindle 92 in opposite directions about its axis relative to support member 28. The space between stop element 100 and outer surface 108 determines the depth of a groove to be rolled in a workpiece during use of the apparatus and, in this respect, the stop element engages outer surface 108 to limit radial inward displacement of support member 28 and thus grooving roll 58 relative to grooving roll 42.

In accordance with one aspect of the invention, the roll grooving apparatus is adapted to be supported relative to support and drive unit 12 such that axis B of idler grooving roll 58 is located laterally outwardly of axis A of the drive shaft and grooving roll 42, whereby a plane through axes A and B is one of horizontal or at an acute angle to horizontal. In the embodiment illustrated in FIGS. 1–6, such support is achieved by providing outer portion 26 of support member 22 with a tubular support sleeve 110 secured to outer surface 108 of plate 26 such as by welds 112. Sleeve 110 is circular in cross-section and is axially slidably received on support element 20 of support and drive unit 12, whereby it will be appreciated that the roll grooving apparatus is mounted on support and drive unit 12 by moving sleeve axially onto support element 20 and moving rear end 38 of drive shaft 30 into chuck mechanism 16 after which the latter is actuated to clampingly interengage with end 38 of the drive shaft so as to rotate the latter upon energization of the motor of the support and drive unit.

Figure 5:
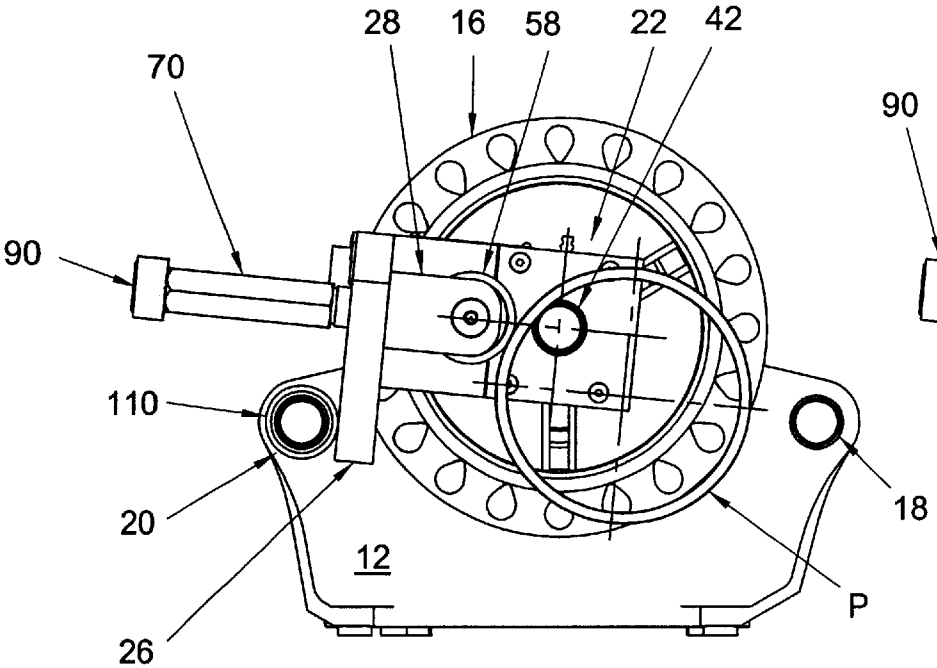
FIG. 5 is a front elevation view of the apparatus and drive unit shown in FIG. 1 and illustrating a pipe to be grooved positioned between the groove rolls prior to the onset of grooving.
Figure 7:
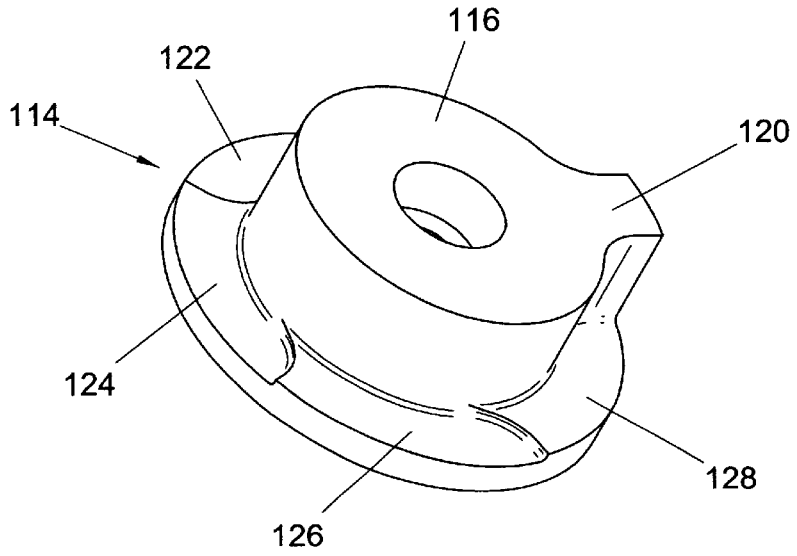
FIG. 7 is a perspective view of a gauge element in accordance with the present invention.

When mounted in the foregoing manner, the roll grooving apparatus is ready to be used and, as will be appreciated from FIG. 5, prior to initiating a roll grooving operation, idler roll 58 is displaced radially outwardly from driven roll 42 by rotating feed screw 70 clockwise in FIG. 1 and then inserting a pipe P between the grooving rolls and against the axially outer side of base portion 24 of support member 22. Feed screw 70 is then turned counterclockwise in FIG. 1 to displace grooving roll 58 radially inwardly toward grooving roll 42 whereby, as will be appreciated from FIG. 6, pipe P rises from the position shown in FIG. 5 to the position shown in FIG. 6 in which grooving of the pipe begins by turning on the power drive which rotates driving grooving roll 42 clockwise in FIG. 6. The weight of the pipe imposes a cantilever type force on the grooving rolls which promotes tracking of the groove with little or no intervention required on the part of the operator to support the pipe so as to assure proper tracking. Preferably, the handle of ratchet wrench 90 extends rearwardly of power unit 12, as seen in FIG. 1, and the ratchet wrench is displaced back and forth through arcuate strokes, the counterclockwise one of which displaces second support member 28 radially inwardly to progressively advance idler grooving roll 58 radially inwardly toward grooving roll 42 so as to progressively roll a groove in the pipe. When the groove reaches a depth determined by the setting of stop element 100, the latter engages outer surface 108 of outer portion 26 of support member 22 to preclude further displacement of grooving roll 58 radially inwardly of grooving roll 42. Advantageously in connection with advancing the feed screw in the foregoing manner through the use of ratchet wrench 90, the force imposed on the wrench by the operator is downwardly and rearwardly of the front of the power unit, thus stabilizing the roll grooving operation by eliminating lateral slipping or tipping of the apparatus as a result of the force application on the feed screw. When the roll grooving operation has been completed, the power drive is turned off and feed screw 70 is rotated clockwise in FIG. 1 to displace grooving roll 58 radially outwardly from grooving roll 42, thus releasing the grooved pipe for removal of the apparatus.

Figure 8:
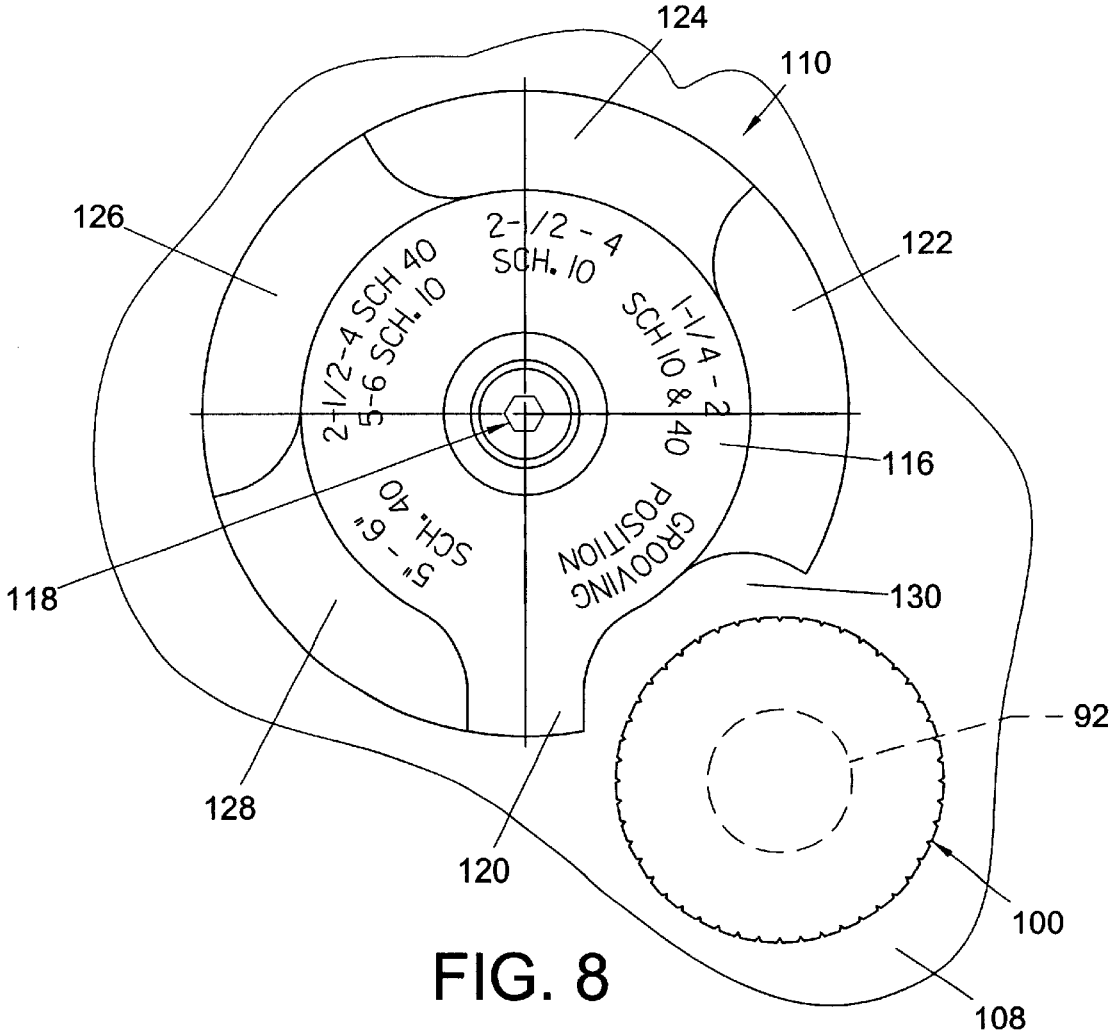
FIG. 8 is an enlarged plan view of the gauge.

Heretofore, a plurality of individual thickness gauges either separate from or tethered to the roll grooving apparatus where provided for insertion between the stop element and surface 108 to enable adjusting the space therebetween and thus the depth of a groove in accordance with the characteristics of the workpiece. In accordance with another aspect of the present invention, as best seen in FIGS. 1, 2, 7, and 8 of the drawing, a gauge member 114 is mounted on outer portion 26 of the first support member laterally adjacent stop element 100 and for displacement relative to the stopped element and support member into and out of a gauging position relative to the stopped member. In the preferred embodiment, gauge 114 is in the form of a circular dial or knob having a hub portion 116 by which the gauge is rotatably mounted on outer portion 26 of support member 22 such as by a hexagonal shoulder screw 118 which provides the axis of rotation for the gauge. Preferably, a wave spring, not shown, is interposed between the head of shoulder screw 118 and the underlying portion of hub 116 to frictionally restrain rotation of the knob. Rotation of the gauge about screw 118 is facilitated by a finger 120 extending radially outwardly from the hub to the outer circumference of the gauge. The gauge includes a gauging surface which, in the preferred embodiment, is defined by a plurality of circumferentially adjacent gauging surface portions 122, 124, 126, and 128 extending about hub 116. For the purpose set forth hereinafter, a recess 130 is provided in the gauge between finger 120 and gauging surface portion 122. Each of the gauging surface portions has a circumferential extent of about 75° and, as will be appreciated from FIG. 7, the surface portions progressively increase in axial thickness in the direction from surface portion 122 to surface portion 128. The thickness of each engaging surface portion provides the necessary spacing between stop element 100 and surface 108 of support member 22 to provide a desired depth of groove for a given pipe. Thus, as shown in FIG. 8 for example, indicia on the portion of the axially outer surface of hub 116 radially inwardly of surface portion 122 indicates that the latter surface portion has a thickness for providing the desired groove depth in 1¼ inch to 2 inch Schedule 10 and 40 pipe. Similarly, the indicia radially inwardly of surface portion 124 indicates that the latter surface portion has a thickness for providing a desired groove depth in connection with roll grooving 2¼ inch to 4 inch Schedule 10 pipe, the indicia inwardly of surface portion 126 indicates the latter is of a thickness to provide a desired grooved depth in roll grooving 2¼ inch to 4 inch Schedule 40 pipe and 5 inch to 6 inch Schedule 10 pipe, and the indicia inwardly of gauging surface portion 128 indicates the latter has a thickness for providing a desired groove depth in connection with roll grooving 2¼ inch to 4 inch Schedule 10 pipe. As the indicia radially inwardly of recess 130 indicates, the latter provides the grooving position for gauge 114. As will be appreciated from FIGS. 7 and 8, together with the description hereinabove regarding FIG. 3, counterclockwise rotation of stop element 100 displaces the latter radially outwardly of surface 108 of support member 22, whereupon gauge 114 can be rotated clockwise about screw 118 from the position shown in FIG. 8 to selectively position one of the gauging surface portions beneath the stop element. The stop element is then rotated clockwise to bring the underside thereof into engagement with the underlying gauging surface portion after which gauge 114 is rotated counterclockwise to return the gauge to the grooving position shown in FIG. 8, and finger 120 is adapted to engage stop element 100 to assure positioning thereof in recess 130. Moreover, the wave spring referred to above advantageously holds gage 114 in the grooving position. As will be appreciated from FIGS. 1, 3 and 8, when gauge 114 is in the grooving position support member 28 and grooving roll 58 can be displaced radially inwardly toward grooving roll 42 until the underside of stop element 100 engages outer surface 108 of support member 22 to limit such movement. As will be appreciated from the foregoing description, when a selected surface portion of gauge 114 underlies stop element 100, the gauge is in a gauging position relative to the stop element, and when the gauge is in the position shown in FIG. 8, it is out of the gauging position and in the grooving position which allows a grooving operation to proceed.

Figure 9:
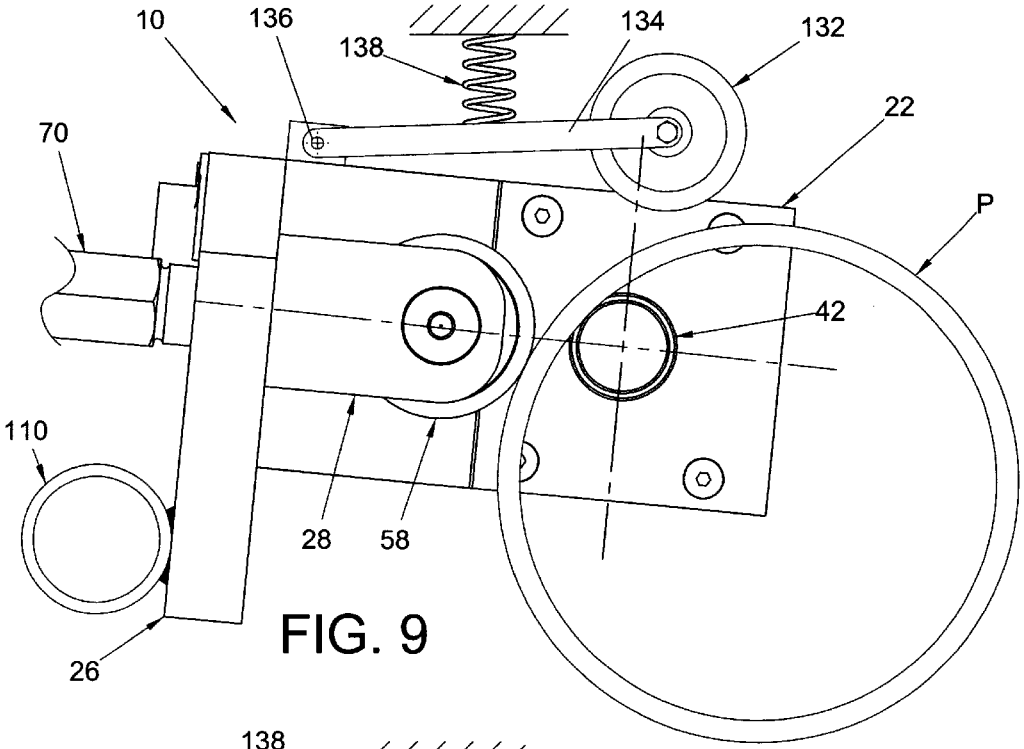
FIG. 9 is a front elevation view similar to FIG. 5 illustrating the position of a stabilizing wheel relative to the pipe prior to the onset of grooving; and, FIG. 10 is a view similar to FIG. 9 and showing the relationship between the pipe, grooving rolls and stabilizing wheel at the onset of grooving.
Figure 10:
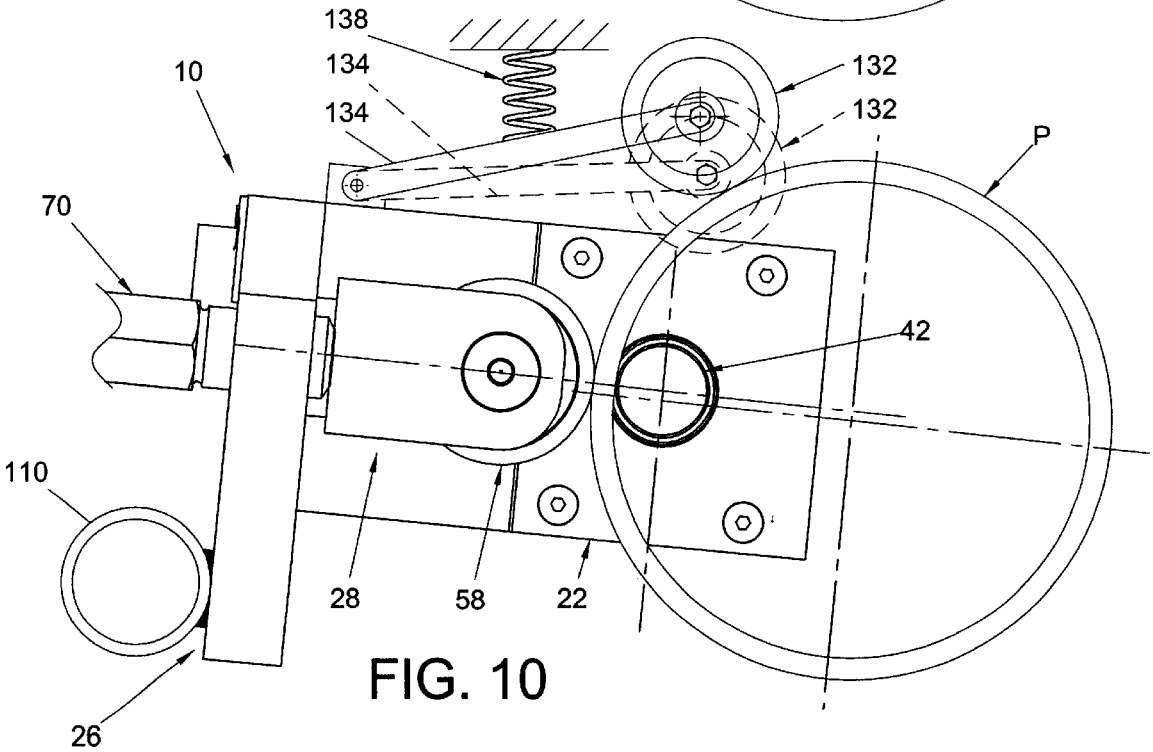

In accordance with another aspect of the invention, as shown in FIGS. 9 and 10 of the drawing, roll grooving apparatus 10 can be provided with a stabilizing wheel arrangement which, in the embodiment illustrated, includes a stabilizing wheel 132 rotatably mounted on the outer end of a support arm 134 having an inner end interconnected with support member 22 of the roll grooving apparatus for pivotal displacement in opposite directions about an arm axis 136 parallel to the grooving roll axes. A biasing spring 138 initially positions stabilizing wheel 132 radially outwardly of a pipe P when the latter is initially positioned between grooving rolls 42 and 58 prior to initiating a grooving operation. When feed screw 70 is turned to displace grooving roll 58 radially inwardly toward grooving roll 42, as described hereinabove in connection with FIGS. 5 and 6 of the drawing, pipe P rises from the position shown in FIG. 9 to the position shown in FIG. 10 in which grooving of the pipe begins and, during such lifting of the pipe, the latter engages against stabilizing wheel 132 which is accordingly displaced upwardly against the bias of spring 138, whereby the wheel supplements the tracking of the groove being formed with respect to the tracking promoted by the weight of the pipe as described hereinabove in connection with FIGS. 5 and 6 of the drawing. While biasing spring 38 is shown as a compression spring, it will be appreciated that arm 134 could be of resilient material and the inner end thereof fixed relative to support member 22, whereby the arm would flex in response to engagement between wheel 132 and pipe P. Furthermore, it will be appreciated that the stabilizing wheel could be fixed relative to support member 22 as opposed to being resiliently biased and in which case an arrangement would be provided for adjusting the position of the support arm relative to support member 22 in accordance with the diameter of pipe to be grooved.

While considerable emphasis has been placed herein on the structures and structural interrelationships between the component parts of the preferred embodiments of the present invention, it will be appreciated that other embodiments as well as modifications of the embodiments disclosed herein can readily be made without departing from the principles of the invention. In particular in this respect, it will be appreciated that the gauge for setting the depth of a groove to be rolled into a workpiece can be used with roll grooving apparatus other than that in which the idler roll is displaced relative to the driving roll by a feed screw arrangement and, in this respect, is applicable to roll grooving apparatus in which such displacement is pivotal rather than linear and/or is achieved through the use of hydraulic rather than mechanical components. Further, it will be appreciated that the support on the apparatus for interengaging with a support element of a power drive unit to support the grooving rolls in a laterally outwardly adjacent relationship can be achieved other than through the use of a sleeve slidably receiving a support element of the power drive and, as opposed to being portable and removably mounted on such a power drive, roll grooving apparatus having the grooving rolls so oriented relative to one another can be constructed as a unitary apparatus with an integral drive arrangement.

Moreover, while the support arrangement is advantageous in connection with a feed screw displacement of the idler roll, it will be appreciated that the improved tracking can be achieved with hydraulic displacement of the idler roll. Still further, while a rotatable groove depth gauge is preferred, it will be appreciated that a gauge slidably mounted on a support member of roll moving apparatus and having grooving surface of variable thickness therealong can be provided for movement into and out of a gauging position relative to a stop element for achieving gauging in the manner disclosed herein. The foregoing and other modifications of the preferred embodiments as well as other embodiments of the invention will be suggested or obvious to those skilled in the art from the disclosures herein, whereby the foregoing descriptive matter is to be interpreted merely as illustrative of the invention and not as a limitation.

Having thus described the invention, it is so claimed:

1. Roll grooving apparatus for rolling a circumferential groove in a pipe comprising first support means, a first grooving roll mounted on said first support means for rotation about a first axis, drive shaft means for drivingly coupling said first grooving roll with drive means, second support means, a second grooving roll mounted on said second support means for rotation about a second axis parallel to said first axis, means interconnecting said first and second support means for displacing said second grooving roll toward and away from said first grooving roll, and means for supporting said first and second support means relative to a drive means for said second axis to be spaced laterally outwardly from said first axis, the drive means including a support member spaced laterally outwardly from said first axis, and said means for supporting said first and second support means including means on said first support means interengaging with said support member.

2. Roll grooving apparatus according to claim 1, wherein a plane through said first and second axes is one of horizontal and at an acute angle to horizontal.

3. Roll grooving apparatus according to claim 1, wherein the support member is linear and has an axis parallel to said first axis, said means on said first support means including a sleeve slidably receiving said support member.

4. Roll grooving apparatus according to claim 3, wherein said support member and said sleeve are circular in cross-section.

5. Roll grooving apparatus according to claim 1, wherein said means interconnecting said first and second support means includes a feed screw threadedly interengaged with said first support means for rotation in opposite directions about a screw axis, said feed screw having inner and outer ends and said screw axis lying in a common plane with said first and second axes, and said second support means being interconnected with said inner end for displacement of said second grooving roll toward and away from said first grooving roll in response to rotation of said feed screw respectively in one and the other of said opposite directions.

6. Roll grooving apparatus according to claim 5, wherein said outer end of said feed screw includes means for interengaging with a tool for rotating said feed screw.

7. Roll grooving apparatus according to claim 5, wherein said common plane is one of horizontal and at an acute angle to horizontal.

8. Roll grooving apparatus according to claim 5, wherein the drive means includes a support member spaced laterally outwardly from said first axis, said means for supporting said first and second support means including means on said first support means interengaging with said support member.

9. Roll grooving apparatus according to claim 8, wherein said common plane is one of horizontal and at an acute angle to horizontal.

10. Roll grooving apparatus according to claim 9, wherein said support member is circular in cross-section and has an axis parallel to said first axis, said means on said first support means including a circular sleeve slidably receiving said support member.

11. Roll grooving apparatus according to claim 10, wherein said outer end of said feed screw includes means for interengaging with a tool for rotating said feed screw.

12. Roll grooving apparatus for rolling a circumferential groove in a pipe comprising first support means, a first grooving roll mounted on said first support means for rotation about a first axis, drive shaft means for drivingly coupling said first grooving roll with drive means, second support means, a second grooving roll mounted on said second support means for rotation about a second axis parallel to said first axis, means interconnecting said first and second support means for displacing said second grooving roll toward and away from said first grooving roll, means for supporting said first and second support means relative to a drive means for said second axis to be spaced laterally outwardly from said first axis, stop means on said second support means having a first position spaced from said first support means and a second position engaging with said first support means to limit displacement of said second support means in the direction for displacing said second grooving roll toward said first grooving roll, said stop means being adjustable relative to said first support means for varying the space between said stop means and said first support means in said first position, and gauge means mounted on said first support means for displacement relative thereto into and out of a gauging position between said stop means and said first support means, whereby said stop means engages said gauge means in said gauging position thereof to set the space between said stop means and said first support means in said first position of said stop means.

13. Roll grooving apparatus according to claim 12, wherein said gauge means has a gauging surface of varying thickness in the direction of the space between said stop means and said first support means and is displaceable relative to said first support means for selectively positioning said gauging surface between said stop means and said first support means for varying the space therebetween in said first position of said stop means.

14. Roll grooving apparatus according to claim 13, wherein said gauging surface has adjacent surface portions stepped in the direction of said space.

15. Roll grooving apparatus according to claim 14, wherein said gauge means is mounted on said first support means for rotation about a gauge axis and said adjacent surface portions are circumferentially adjacent about said gauge axis.

16. Roll grooving apparatus for rolling a circumferential groove in a pipe, said apparatus being removably mountable on separate support and drive means including spaced apart and parallel support elements and a drive motor having drive coupling means and a coupling axis between and parallel to said support elements, said apparatus including a first support member, shaft means rotatably supported in said first support member and having a shaft axis coaxial with the coupling axis of the support and drive means, said shaft means having front and rear ends, a first grooving roll on said front end of said shaft means for rotation therewith and means on said rear end for coupling engagement with the coupling means of the support and drive means, a second support member, a second grooving roll mounted on said second support member for rotation about a roll axis parallel to said shaft axis, means interconnecting said first and second support members for displacing said second grooving roll toward and away from said first grooving roll, said roll axis being between said shaft axis and an outer end of said first support member, and means on said outer end of said first support member for engaging with one of the support elements of the support and drive means, whereby said apparatus when mounted on the support and drive means is supported between the shaft means and the one support element thereof.

17. Roll grooving apparatus according to claim 16, further including stop means on said second support member having a first position spaced from said first support member and a second portion engaging with said first support member to limit displacement of said second support member in the direction for displacing said second grooving roll toward said first grooving roll, said stop means being adjustable relative to said first support member for varying the space between said stop means and said first support member in said first position, and gauge means mounted on said first support member for displacement relative thereto into and out of a gauging position between said stop means and said first support member, whereby said stop means engages said gauge means in said gauging position thereof to set the space between said stop means and said first support member in said first position of said stop means.

18. Roll grooving apparatus according to claim 17, wherein said gauge means has a gauging surface of varying thickness in the direction of the space between said stop means and said first support member and is displaceable relative to said first support member for selectively positioning said gauging surface between said stop means and said first support member for varying the space therebetween in said first position of said stop means.

19. Roll grooving apparatus according to claim 18, wherein said gauging surface has adjacent surface portions stepped in the direction of said space.

20. Roll grooving apparatus according to claim 19, wherein said gauge means is mounted on said first support member for rotation about a gauge axis and said adjacent surface portions are circumferentially adjacent about said gauge axis.

21. Roll grooving apparatus according to claim 16, wherein the one support element is circular in cross-section and said means on said outer end of said first support member is a sleeve for slidably receiving the one support element.

22. Roll grooving apparatus according to claim 16, wherein said first support member includes a first portion transverse to said shaft axis and a second portion extending from said first portion parallel to said shaft axis and providing said outer end of said first support member, said means on said outer end of said first support member for engaging with one of the support elements being on said second portion of said first support member.

23. Roll grooving apparatus according to claim 22, wherein said means on said outer end is a sleeve on said second portion for slidably receiving the one support element.

24. Roll grooving apparatus according to claim 22, wherein said means interconnecting said first and second support members includes actuating means on said second portion of said first support member, said actuating means having an inner end relative to said shaft axis, said second support member being mounted on said inner end, and means for displacing said inner end in opposite directions to displace said second grooving roll toward and away said first grooving roll.

25. Roll grooving apparatus according to claim 24, wherein said actuating means includes a feed screw threadedly interengaged with said second portion of said first support member for rotation of said feed screw in opposite directions to respectively displace said inner end in one and the other of said opposite directions.

26. Roll grooving apparatus according to claim 25, further including stop means on said second support member having a first position spaced from said second portion of said first support member and a second position engaging with said second portion of said first support member to limit displacement of said second support member in the direction for displacing said second grooving roll toward said first grooving roll, said stop means being adjustable relative to said second portion of said first support member for varying the space between said stop means and said second portion of said first support member in said first position, and gauge means mounted on said second portion of said first support member for displacement relative thereto into and out of a gauging position between said stop means and said second portion of said first support member, whereby said stop means engages said gauge means in said gauging position thereof to set the space between said stop means and said second portion of said first support member in said first position of said stop means.

27. Roll grooving apparatus according to claim 26, wherein said gauge has a gauging surface of varying thickness in the direction of the space between said stop means and said second portion of said first support member and is displaceable relative to said second portion of said first support member for selectively positioning said gauging surface between said stop means and said second portion of said first support member for varying the space therebetween in said first position of said stop means.

28. Roll grooving apparatus according to claim 27, wherein said gauging surface has adjacent surface portions stepped in the direction of said space.

29. Roll grooving apparatus according to claim 28, wherein said gauge is mounted on said second portion of said first support member for rotation about a gauge axis and said adjacent surface portions are circumferentially adjacent about said gauge axis.

30. Roll grooving apparatus according to claim 25, wherein said feed screw has an outer end including means for interengaging with a tool for rotating said feed screw.

31. Roll grooving apparatus according to claim 30, wherein said means on said outer end is a sleeve on said second portion for slidably receiving the one support element.

32. Roll grooving apparatus according to claim 25, wherein said means on said outer end is a sleeve on said second portion for sidably receiving the one support element.

33. In roll grooving apparatus comprising first support means, a first grooving roll mounted on said first support means for rotation about a first axis, second support means, a second grooving roll mounted on said second support means for rotation about a second axis parallel to said first axis, means interconnecting said first and second support means for relative displacement therebetween for displacing said first and second grooving rolls toward and away from one another, and stop means on one of said first and second support means having a first position spaced from the other support means and a second position engaging with the other support means to limit said relative displacement in the direction for displacing said first and second grooving rolls toward one another, said stop means being adjustable relative to the other support means for varying the space between said stop means and the other support means in said first position of the stop means, the improvement comprising: gauge means mounted on the other of said support means adjacent said stop means for displacement relative thereto into and out of a gauging position between said stop means and said other support means, said gauge means in said gauging position being positioned relative to said stop means for setting the space between said stop means and said other support means in said first position of said stop means.

34. The improvement according to claim 33, wherein said gauge means has a gauging surface of varying thickness in the direction of the space between said stop means and said other support means and is displaceable relative to said other support means and said stop means for selectively positioning said gauging surface between said stop means and said other support means for varying the space therebetween in said first position of said stop means.

35. The improvement according to claim 34, wherein said gauge surface has adjacent surface portions stepped in the direction of said space.

36. The improvement according to claim 35, wherein said gauge means is mounted on said other support means for rotation about a gauge axis and said adjacent surface portions are circumferentially adjacent about said gauge axis.

37. The improvement according to claim 33, wherein said first support means comprises a first support member, drive shaft means supported in said first support member for rotation about a shaft axis, said drive shaft means having front and rear ends, said first grooving roll being on said front end for rotation with said drive shaft means, said rear end including means for coupling said shaft means with drive means, said second support means comprising a second support member slidably supported on said first support member for displacement radially of said shaft axis, said second grooving roll being mounted on said second support member for displacement therewith, said means interconnecting said first and second support means including means for displacing said second support member relative to said first support member, said second support member being said one support means, and said first support member being said other support means.

38. The improvement according to claim 37, wherein said first support member includes an outer portion radially spaced from and parallel to said shaft axis, said second support member being between said outer portion and said drive shaft means, said outer portion having a radially outer side, said stop means extending through said outer portion and having an inner end interconnected with said second support member for displacement therewith and an outer end radially outwardly of said outer side of said outer portion, said outer end of said stop means including a stop element for engaging with said outer side to limit displacement of said second support member toward said drive shaft means.

39. The improvement according to claim 38, wherein said inner end of said stop means is threadedly interconnected with said second support member and said stop element is a knob for rotating said stop means relative to said second support member.

40. The improvement according to claim 38, wherein said gauge means is mounted on said radially outer side of said outer portion of said first support member and has a gauging surface of varying thickness in the direction of the space between said outer side and said stop element on said outer end of said stop means, said gauge means being displaceable relative to said stop element for selectively positioning said gauging surface between said outer side and said stop element for varying the space therebetween in said first position of said stop means.

41. The improvement according to claim 40, wherein said gauging surface has adjacent surface portions stepped in the direction of said space.

42. The improvement according to claim 41, wherein said gauge means is mounted on said other support means for rotation about a gauge axis and said adjacent surface portions are circumferentially adjacent about said gauge axis.

43. The improvement according to claim 42, wherein said gauging surface is circumferentially interrupted to provide a circumferential space position able relative to said stop element for said gauge means to be out of said gauging position.

44. The improvement according to claim 43, wherein said inner end of said stop means is threadedly interconnected with said second support member and said stop element is a knob for rotating said stop means relative to said second support member, said circumferential space being positioned to receive said knob when said gauge means is out of said gauging position.

45. The improvement according to claim 40, wherein said means interconnecting said first and second support means includes a feed screw extending radially inwardly through said outer portion of said first support member and having inner and outer ends, said feed screw being threadedly interengaged with said outer portion for rotation of said feed screw in opposite directions to displace said inner end in radially opposite directions, said second support member being interconnected with said inner end of said feed screw for radial displacement therewith, and said outer end of said feed screw including means for manually rotating the feed screw in opposite directions.

46. The improvement according to claim 45, wherein said inner end of said stop means is threadedly interconnected with said second support member and said stop element is a knob for rotating said stop means relative to said second support member.

47. The improvement according to claim 46, wherein said gauging surface has adjacent surface portions stepped in the direction of said space.

48. The improvement according to claim 47, wherein said gauge means is mounted on said other support means for rotation about a gauge axis and said adjacent surface portions are circumferentially adjacent about said gauge axis.

49. The improvement according to claim 48, wherein said gauging surface is circumferentially interrupted to provide a circumferential space positionable relative to said stop element for said gauge means to be out of said gauging position, said circumferential space being positioned to receive said knob when said gauge means is out of said gauging position.

* * * * *

UNITED STATES PATENT AND TRADEMARK OFFICE

CERTIFICATE OF CORRECTION

PATENT NO. : 6,272,895 B1
APPLICATION NO. : 09/571145
DATED : August 14, 2001
INVENTOR(S) : Hamm It is certified that error appears in the above-identified patent and that said Letters Patent is hereby corrected as shown below:

Column 1, line 45, after “thereof” insert --.--.

Column 4, line 36, delete “extends” and insert therefor --extend--; line 54, delete “32” and insert --36-- therefor, and insert --.-- at the end of the line.

Column 7, line 8, delete “stopped” and insert therefor --stop--; line 9, delete “stopped member” and insert therefor --stop element--; line 37, “11/4” should read --1-1/4--; line 41, “21/4” should read --2-1/4--; line 44, “21/4” should read --2-1/4--; and line 48, “21/4” should --2-1/4--.

Column 9, line 7, after “having” insert --a--.

Column 12, line 47, after “end” insert --of said first support member--.

Column 14, line 19, “position able” should --positionable--.

Signed and Sealed this

Nineteenth Day of February, 2008

JON W. DUDAS
*Director of the United States Patent and Trademark Office*